United States Patent [19]

Aida et al.

[11] Patent Number: 4,840,153

[45] Date of Patent: Jun. 20, 1989

[54] HYDRAULIC LASH ADJUSTER

[75] Inventors: Akira Aida; Toshihiro Ikeda, both of Takasaki, Japan

[73] Assignee: Nippon Seiko Kabushiki Kaisha, Tokyo, Japan

[21] Appl. No.: 145,121

[22] Filed: Jan. 19, 1988

[30] Foreign Application Priority Data

Oct. 23, 1987 [JP] Japan ..... 62-266538

[51] Int. Cl.[4] ..... F01L 1/24

[52] U.S. Cl. ..... 123/90.55; 123/90.43

[58] Field of Search ..... 123/90.43, 90.46, 90.55, 123/90.56, 90.57, 90.58, 90.63, 90.35

[56] References Cited

U.S. PATENT DOCUMENTS

| | | | |
|---|---|---|---|
| 2,737,934 | 3/1953 | Banker | 123/90.55 |
| 2,815,740 | 12/1957 | Slater | 123/90.55 |
| 3,799,129 | 3/1974 | Cornell | 123/90.46 X |
| 4,184,464 | 1/1980 | Svihlik | 123/90.55 |
| 4,387,675 | 6/1983 | Hori et al. | 123/90.58 |
| 4,481,913 | 11/1984 | Wirth | 123/90.55 X |
| 4,633,827 | 1/1987 | Buente | 123/90.55 |

FOREIGN PATENT DOCUMENTS 2343269 8/1975 Fed. Rep. of Germany .

*Primary Examiner*—Willis R. Wolfe

*Attorney, Agent, or Firm*—Shapiro and Shapiro

[57] ABSTRACT

A lash adjuster has a plunger assembly comprising a plunger and a plunger cap. A separator is provided in the plunger cap to prevent the air mixed in the introduced oil from flowing into a reservoir chamber. The plunger cap further has a valve device in addition to the separator for preventing external air from being drawn into the lash adjuster.

17 Claims, 2 Drawing Sheets

HYDRAULIC LASH ADJUSTER

BACKGROUND OF THE INVENTION

1. Field of the Invention

This invention relates to a hydraulic lash adjuster, and more particularly to a hydraulic lash adjuster provided with a valve device for preventing external air from being drawn into a high pressure chamber of the adjuster when an engine is re-started.

2. Related Background Art

Heretofore, in ordinary internal combustion engines, in order to accommodate the difference between the expansion of a cylinder head by heat and the expansion of a valve mechanism, a hydraulic lash adjuster has been used to provide a proper, usually zero, valve clearance and to prevent both noise during the operation of the engine and horsepower loss by a draft of raw gas.

Further, it has been known to use such a lash adjuster to cause oil passing through the lash adjuster to be discharged from an oil outlet provided in the lash adjuster in order to lubricate the surface of contact of a swing arm with a cam and thereby prevent abrasion of the surface of contact.

The lash adjuster held in a cylinder block is disposed in intimate contact with the underside of one end of the swing arm so that the oil outlet of the lash adjuster is opposed to an oil injection port of the swing arm. One end of a poppet valve bears against the underside of the other end of the swing arm. Further, the camming surface of the cam rotatably bears against the upper surface of the swing arm to constitute a surface of contact therebetween.

The oil discharged from the oil outlet of the lash adjuster passes through the oil injection port of the swing arm and along the upper surface of the swing arm to said surface of contact. Thus, the surface of contact is lubricated by that oil. This is an improvement as compared with the case where the surface of contact was lubricated only by the lubricating oil from around the cam shaft.

However, a lash adjuster as just described is subject to problems due to air mixing air with the oil supplied thereto. When such oil enters a reservoir chamber, the oil having air mixed therewith in the reservoir chamber gradually moves from a check valve into a high pressure chamber because a slight amount of oil flowing out from a minute gap is supplied during each rotation of the cam shaft. As a result, the oil in the high pressure chamber becomes spongy, thus causing noise and impairing the function of the lash adjuster. The above-noted phenomenon becomes particularly noticeable when the engine oil is hot and the engine is revolving at a low speed.

SUMMARY OF THE INVENTION

Thus, the object of the present invention is to provide a hydraulic lash adjuster of the type in which the surface of contact between a cam and a swing arm is lubricated by oil passed through the lash adjuster and which can solve the above-noted problems and prevent air from being drawn into the high pressure chamber, whereby the lash adjuster is stable in operation and can sufficiently follow the revolution of the engine.

Another object of the invention is to provide a hydraulic lash adjuster for adjusting the valve clearance of an engine valve and supplying oil to lubricate a surface to be lubricated through said lash adjuster, said lash adjuster comprising a cup-shaped body having an oil introducing port and an inner chamber; a plunger assembly axially movably fitted in said inner chamber, said assembly including a partition wall having a hole so as to divide said inner chamber into first and second compartments in the axial direction, an oil outlet port at the top thereof and an oil supply inlet provided in a peripheral wall thereof to communicate with said oil introducing port; a high pressure chamber defined in said first compartment of said inner chamber and having valve means to seat on said hole; a reservoir chamber defined in said second compartment in the opposite direction with respect to said high pressure chamber; a separator provided in said plunger assembly for dividing said reservoir chamber into two spaces; and a valve device having an oil passage provided in said plunger assembly in order to prevent sucking in air through said oil outlet port.

A further object of the invention is to provide a hydraulic lash adjuster for adjusting the valve clearance of an engine valve and supplying oil to lubricate a surface to be lubricated through said lash adjuster, said lash adjuster comprising a cup-shaped body having an oil introducing port and an inner chamber; a plunger assembly axially movably fitted in said inner chamber, said assembly including a partition wall having a hole so as to divide said inner chamber into first and second compartments in the axial direction, an oil outlet port at the top thereof and an oil supply inlet provided in a peripheral wall thereof; a high pressure chamber defined in said first compartment of said inner chamber and having valve means to seat on said hole; a reservoir chamber defined in said second compartment in the opposite direction with respect to said high pressure chamber; and a separator provided in said plunger assembly for dividing said reservoir chamber into two spaces, said separator having such a shape as to converge the space defined between the inner surface of said plunger assembly and the outer surface of said separator toward said oil outlet.

As described above, in the present invention, the cap of the hydraulic lash adjuster is provided with a valve device. Therefore, even if the engine is restarted during the bearing of a cam nose, the valve device works and the external air is not drawn into the high pressure chamber of the lash adjuster.

Further, because the separator is provided in a reservoir chamber, air mixed in the introduced oil is prevented from being drawn into the high pressure chamber.

DESCRIPTION OF THE PREFERRED EMBODIMENTS

Figure 1:
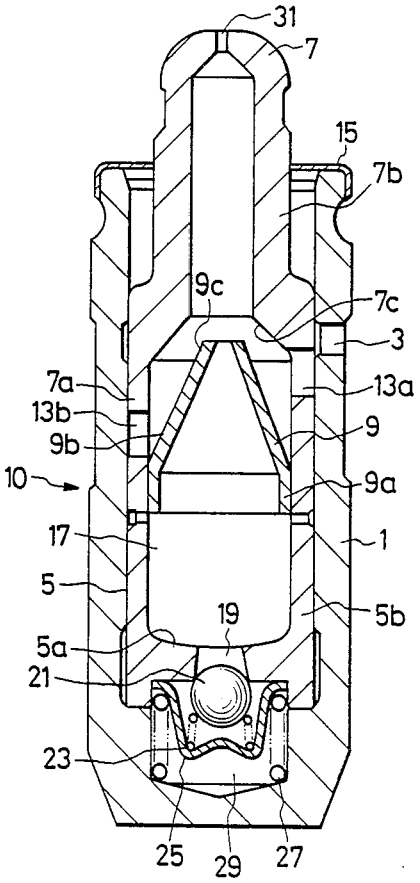
FIG. 1 is a axial cross-sectional view of a lash adjuster according to a first embodiment of the present invention.

Embodiments of the present invention will hereinafter be described in detail with reference to the accompanying drawings. In the drawings, corresponding elements are designated by the same reference characters.

FIG. 1 is an axial cross-sectional view of a lash adjuster 10 according to a first embodiment of the present invention. The adjuster 10 is provided with a substantially cylindrical cup-shaped body 1 having a substantially cylindrical inner chamber or space therein. An oil introducing port 3 for introducing oil into the lash adjuster 10 is formed in the side of the upper part of the cylindrical portion of the body 1. Near the bottom of the inner space of the body 1, a cylindrical plunger 5 of substantially H-shaped cross-section which divides the inner space into two chambers is fitted for sliding movement in the axial direction within the body 1.

On the axially upper portion of the plunger 5, there is a plunger cap, i.e., a cap 7, comprising a cylindrical large-diametered portion 7*a* and a cylindrical small-diametered portion 7*b*. The plunger cap is slidably fitted to the inner peripheral surface of the body 1 by means of the large-diametered portion 7*a*. The lower end of the large-diametered portion 7*a* of the cap 7 bears against the upper end of the plunger 5, and the cap 7 is axially slidable substantially as a unit with the plunger. A cap retainer 15 is provided on the upper open end portion of the body 1 to retain the cap 7 so that the plunger 5 and the cap 7 may not fall out of the body 1 during the assembly of the lash adjuster. The plunger 5 and the plunger cap 7 may be made into a unitary member with their end portions bearing against each other being fixed to each other, such as by welding, as required.

The plunger 5 comprises a cylindrical portion 5*b* and an inner partition wall 5*a* integral therewith, and divides the space in the body 1 into two chambers to either side of the partition wall 5*a*. A high pressure chamber 29 is defined between the partition wall 5*a* and a recess formed in the bottom of the body 1, and a reservoir chamber 17 in which there is stored oil to be introduced into the high pressure chamber 29 is defined between the partition wall 5*a* and the large-diametered portion 7*a* of the cap 7.

A through-hole 19 is formed substantially centrally of the partition wall 5*a* of the plunger 5 so that the operating oil can flow from the reservoir chamber 17 into the high pressure chamber 29. In the high pressure chamber 29, a check valve ball 21 seated in the through-hole 19 is biased upwardly, namely, in a direction to be seated in the through-hole 19, by a check valve spring 23 retained on a check valve retainer 25. The check valve retainer 25 is supported by a plunger spring 27 which biases the plunger 5 upwardly, and bears against the marginal portion of the partition wall 5*a*.

Oil ports 13*a* and 13*b* communicating with the oil introducing port 3 of the body 1 to introduce the oil into the cap 7 are provided in the large-diametered portion 7*a* of the cap 7 at axially different locations. Additionally, a conical separator 9 having open axial ends partitions the reservoir chamber 17 from the interior of the cap 7 and prevents the entry of air into the reservoir chamber 17. The separator 9 is press-fitted to the end portion of the large-diametered portion 7*a* which is adjacent to the plunger 5.

The separator 9, as can be seen in FIG. 1, comprises a cylindrical portion 9*a* press-fitted to the end portion of the cap 7, and a conical portion 9*b* integrally extending therefrom and progressively reduced in diameter toward an oil outlet to be described. The conical portion 9*b* extends to an open end 9*c* at its smallest diameter. The separator 9, as a whole, is of a conical shape, and more specifically, of a frusto-conical shape, as shown in the cross-sectional view of FIG. 1.

The space defined by the outer peripheral surface of the conical portion 9*b* of the separator 9 and the conical inner peripheral surface 7*c* of the large-diametered portion 7*a* (at which the cap 7 forms a wall portion of the reservoir chamber) is constructed so as to be most constricted at the end 9*c*. Therefore, the flow of oil to the reservoir chamber 17 through the oil introducing port 3 and the oil ports 13*a* and 13*b* is stabilized, and entry of the introduced oil into the reservoir chamber 17 inside the separator 9 is prevented. Accordingly, the lash adjuster 10 as a whole can perform the function of a tappet.

The aforementioned space is gradually converged toward the oil outlet 31 and the oil flow is not broken up. Therefore, this arrangement of the separator prevents the aerated oil from flowing into the reservoir chamber 17.

Also, of course, the oil introducing port 3 and the oil ports 13*a* and 13*b* must be provided more toward the oil outlet 31 than the cylindrical portion 9*a* which is the press-fitted portion of the separator 9.

An oil outlet 31 for supplying lubricating oil to the surface of contact 52 (see FIG. 4) between a cam 53 and a swing arm 51 (see FIG. 4) opens at the tip end of the small-diametered portion 7*b* of the cap 7. Accordingly, the supplied oil, having passed through the oil introducing port 3 and the oil ports 13*a* and 13*b* and having entered the cap 7, passes through the space between the conical portion 9*b* of the separator 9 and the inner surface 7*c* of the cap 7 and through the interior of the small-diametered portion 7*b* of the cap 7 and is ejected outwardly through the oil outlet 31.

The oil passage is throttled by the swing arm (FIG. 4) and/or oil outlet 31, and thus the back pressure is generated in the lash adjuster. This back pressure decreases or suppresses aeration. The higher the back pressure, the less the degree of aeration, and the back pressure dominates in the reservoir chamber 17.

As mentioned above, the swing and/or the oil outlet 31 is preferably arranged in such a manner back pressure is generated in the reservoir chamber 17.

Figure 2:
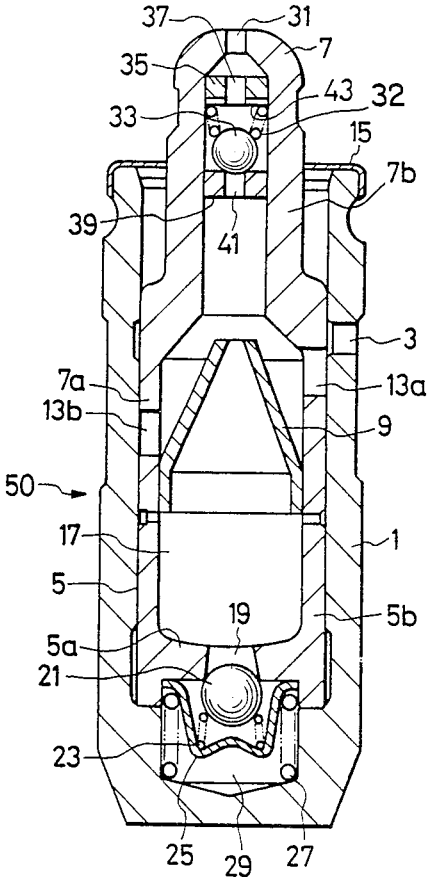
FIG. 2 is an axial cross-sectional view of a lash adjuster according to a second embodiment of the present invention.

FIG. 2 is an axial cross-sectional view of a lash adjuster 50 according to a second embodiment of the present invention. The lash adjuster 50 is provided with a substantially cylindrical cup-shaped body 1 having a substantially cylindrical inner chamber or space therein. An oil introducing port 3 for introducing oil into the lash adjuster 50 is formed in the side of the upper part of the cylindrical portion of the body 1. Near the bottom of the inner space of the body 1, a cylindrical plunger 5 of substantially H-shaped cross-section which divides the inner space into two chambers is fitted for sliding movement in the axial direction within the body 1. The essential portions of the second embodiment are identical to those of the first embodiment and are therefore given corresponding reference characters.

On the axially upper portion of the plunger 5, there is a pluger cap, i.e., a cap 7, comprising a cylindrical large-diametered portion 7*a* and a cylindrical small-diametered portion 7*b*. Plunger cap 7 is slidably fitted to the inner peripheral surface of the body 1 by means of the large-diametered portion 7*a*. The lower end of the large-diametered portion 7*a* of the cap 7 bears against the upper end of the plunger 5, and the cap 7 is axially slidable substantially as a unit with the plunger. A cap retainer 15 is provided on the upper open end portion of the body 1 to retain the cap 7 so that the plunger 5 and the cap 7 may not fall out of the body 1 during the assembly of the lash adjuster 50.

The plunger 5 and the plunger cap 7 may be made into a unitary or integral member with their end portions which are in contact with each other being fixed to each other, such as by welding, as required.

The plunger 5 comprises a cylindrical portion 5*b* and an inner partition wall 5*a* integral therewith, and divides the space in the body 1 into two chambers to either side of the partition wall 5*a*. A high pressure chamber 29 is defined between the partition wall 5*a* and a recess formed in the bottom of the body 1, and a reservoir chamber 17 in which the oil to be introduced into the high pressure chamber is stored is defined between the partition wall 5*a* and the large-diametered portion 7*a* of the cap 7.

A through-hole 19 is formed substantially centrally of the partition wall 5*a* of the plunger 5 so that the operating oil can flow from the reservoir chamber 17 into the high pressure chamber 29. In the high pressure chamber 29, a check valve ball 21 seated in the through-hole 19 is biased upwardly, namely, in a direction to be seated in the through-hole 19, by a check valve spring 23 retained on a check valve retainer 25. The check valve retainer 25 is supported by a plunger spring 27 and bears against the marginal portion of the partition wall 5*a*.

Oil ports 13*a* and 13*b* communicating with the oil introducing port 3 of the body 1 to introduce the oil into the cap 7 are provided in the large-diametered portion 7*a* of the cap 7 at axially different locations. A separator 9 is press-fitted to the end portion of the large-diametered portion 7*a* which is adjacent to the plunger 5, thus partitioning the reservoir chamber 17 from the interior of the cap 7 and preventing the entry of air into the reservoir chamber 17. The separator 9 comprises a cylindrical portion fitted to the cap 7 and a conical portion progressively reduced in diameter toward the small-diametered portion 7*b* of the cap 7.

An oil outlet 31 for supplying lubricating oil to the surface of contact 52 (see FIG. 4) between a cam 53 and a swing arm 51 (see FIG. 4) opens at the tip end of the small-diametered portion 7*b* of the cap 7. In the interior of the small-diametered portion 7*b*, a substantially circular first valve seat 35 is press-fitted near the oil outlet 31, and a substantially circular second valve seat 39 is press-fitted to the small-diametered portion 7*b* slightly further away from outlet 31. A valve ball 33 is disposed between the first and second valve seats 35 and 39 disposed with a predetermined interval therebetween, and is selectively seated on one of these valve seats. The first and second valve seats 35 and 39 are formed with through-holes 37 and 41, respectively, for passing the lubricating oil therethrough. The surface of the first valve seat 35 on which the valve ball 33 is seated is formed with a plurality of grooves 43 radially extending from the through-hole 37. In the present embodiment, the grooves 43 are shown as two, but of course, more than two such grooves may be provided if required.

The operation of the lash adjuster according to the present invention will now be described with reference to FIG. 4 which shows a valve mechanism. In the following description, the lash adjuster 10 of the first embodiment will be described by way of example.

Figure 4:
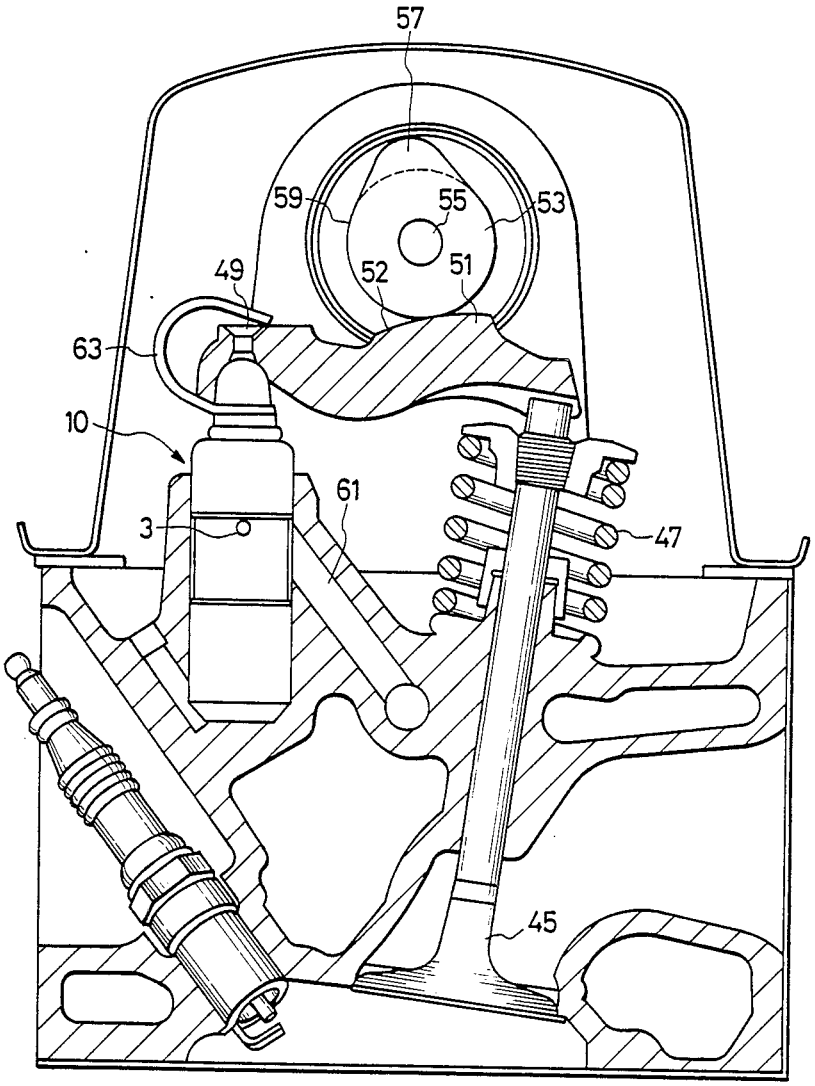
FIG. 4 is a cross-sectional view showing a valve mechanism incorporating a lash adjuster according to the present invention.

Referring to FIG. 4, the lash adjuster 10 is disposed at a predetermined position in an engine cylinder head. During the assembly of the lash adjuster, the high pressure chamber 29 and the reservoir chamber 17 below the separator 9 are pre-filled with operating oil having little or no air mixed therewith.

Oil such as engine oil having a relatively great amount of air mixed therewith is supplied from an oil passage 61 and passes through the oil introducing port 3 formed in the body 1 of the lash adjuster 10. The engine oil then passes through the oil ports 13*a* and 13*b* of the cap 7 and is introduced into the lash adjuster 10. The introduced oil goes upwardly along the outer surface of the conical separator 9 and fills the large-diametered portion 7*a* and small-diametered portion 7*b* of the cap 7. At this time, the oil introduced from the outside hardly enters the reservoir chamber 17 because the separator 9 is provided. Thus, the air contained in the introduced oil from the oil introducing port 3 is prevented from mixing with the operating oil in the reservoir chamber 17.

The tip end of the cap 7 of the lash adjuster 10 is fixed to one end of the swing arm 51 by means of a clip 63. Design is made such that at this time, the oil outlet in the tip end portion of the cap 7 and an oil injection port 49 of the swing arm 51 are opposed to each other. Thus, during the normal engine operation, the swing arm 51 swings with the tip portion of the cap 7 as the fulcrum.

The upper end of a poppet valve 45 bears against the lower surface of the other end of the swing arm 51, and the poppet valve 45 is biased upwardly, namely, in a direction to be closed, by a spring 47. The cam 53 is fixed to a cam shaft 55 and rotates with rotation of the cam shaft 55. The swing arm 51 has a surface of contact 52 between it and the cam 53. Lubricating oil is supplied from the peripheral surface of the cam shaft 55 to the surface of contact.

When the engine is stopped with the cam nose 57 of the cam 53 bearing against the surface of contact 52, the swing arm 51 fixed by the clip 63 is pushed by the cam nose 57 and is subjected to a moment with the cam nose 57 as the fulcrum.

When time further elapses in this state, the lash adjuster 10 is subjected to a downward moment from the swing arm 51 because the biasing force of the spring 47 which biases the poppet valve 45 is considerably great as compared with the biasing force of the plunger spring 27 in the high pressure chamber 29 in the lash adjuster 10. Further, simultaneously therewith, the lash adjuster is subjected to the pressure force from the cam nose 57. Therefore, the high pressure chamber 29 becomes almost collapsed and assumes the so-called bottomed state. This state is shown in FIGS. 1 and 2.

The details of the operation of the second embodiment of the present invention will now be described with reference to FIG. 2.

FIG. 2 shows a state in which the high pressure chamber 29 is most collapsed. When the lash adjuster 50 is in its operative state, the oil introduced from the oil introducing port 3 passes through the lash adjuster 50 toward the oil outlet 31. Accordingly, in the normal operative state of the lash adjuster 50, due to the pressure applied to the oil passing through the lash adjuster 50, the valve ball 33 is seated on the first valve seat 35 so as to close the through-hole 37 in the valve seat 35. However, the passage of the oil is not hampered because the valve seat 35 is formed with the grooves 43 radially extending from the through-hole 37.

When the engine is again started after it has been stopped with the cam nose 57 bearing against the surface of contact 52, the cam 53 rotates and the cam nose 57 moves around the base circle 59. Consequently the load applied to the lash adjuster 50 is rapidly reduced, the high pressure chamber 29 is expanded, and external air is drawn by way of the oil outlet 31 into the cap 7 of the lash adjuster 50 from the oil injection port 49 of the swing arm 51.

At that time, the pressure of the air from the outside becomes greater than the pressure of the oil in the cap 7. Thus, as soon as the external air is drawn into the cap 7, the valve ball 33 becomes seated on the second valve seat 39 so as to close the through-hole 41. Accordingly, the external air can enter the valve device, but is blocked from the reservoir chamber 17 beyond it. The seating of ball 33 on seat 39 thus prevents any appreciable amount of external air from being drawn into the high pressure chamber 29, and the high-pressure operating oil in the high pressure chamber 29 does not become spongy. This is particularly advantageous when the return stroke from the cam nose is great.

Figure 3A:
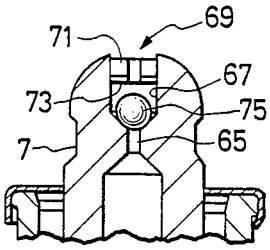
FIG. 3A is an axial fragmentary cross-sectional view of a lash adjuster according to a third embodiment of the present invention.

A third embodiment of the present invention will now be described with reference to FIG. 3A. In the third embodiment, a second valve seat 65 of the valve device is integral with the cap 7, and the inner wall of the cap 7 protrudes annularly so as to have a through-hole at the center thereof. An oil outlet 69 provides a cylindrical cavity 67 extending with substantially the same diameter from the tip end of the cap 7 to the second valve seat 65, and a first valve seat 71 is fitted in the cavity 67 near the end of the oil outlet 69. The first valve seat 71 is substantially similar in construction to the valve seat 35 in the second embodiment.

Accordingly, again in the third embodiment, when during the driving of the engine, the lash adjuster 50 is performing its normal operation, a valve ball 75 is seated on the first valve seat 71, and the lubricating oil is discharged from the oil outlet 69 to the surface of contact 52 by way of grooves 73. Also, when the engine is started from the bearing state of the cam nose 57, the valve ball 75 becomes seated on the second valve seat 65 in the same manner as in the second embodiment, whereby the external air is prevented from being drawn into the high pressure chamber 29 of the lash adjuster 50. According to the third embodiment, the second valve seat is formed integrally with the cap 7 and therefore, the number of parts can be reduced by one as compared with the second embodiment.

Where the lash adjuster 50 according to the present invention is used not in a vertically disposed engine, but in a V-type engine or a horizontally opposed engine, the valve ball of the second and third embodiments may be biased toward the second valve seat (39, 65) by a compression coil spring or like spring, as indicated for example at 32 in FIG. 2, between the valve ball and the first valve seat to stabilize the seating of the valve ball. Of course, the biasing force of such spring must be set smaller than the pressure of the oil introduced through the oil introducing port 3.

As discussed above, the first valve seats 35 and 71 in the second and third embodiments are provided with oil escape grooves 43 and 73, respectively, radially extending from the through-hole in the valve ball seating surfaces. However, these first valve seats may be of any design providing a gap for permitting the escape of oil when the valve ball has been seated thereon. For example, the through-hole in which the valve ball is to be seated may be eliminated and instead, a part of the circumference of the substantially circular first valve seat may be cut away to form a gap between it and the inner surface of the cap 7 so as to provide an oil escape path. The size and number of such cut-away portions can be freely selected to meet the needs of a particular application. When two such cut-aways are provided, they may preferably be opposed radially to each other; whereas when three or more cut-aways are provided, they may preferably be arranged symmetrically about the periphery of the valve seat. Also, oil escape paths provided by a plurality of small holes formed axially through a disc-like plate may be employed as the first valve seat.

Finally, a fourth embodiment of the present invention will be described with reference to FIG. 3B. In the present embodiment, there is no separate member as the first valve seat, and an oil outlet 83 has the function of the first valve seat. In the inner peripheral surface of the oil outlet 83, there are provided oil escape vertical grooves 85 which extend axially there-through and communicate the interior of the cap 7 with the exterior of the cap when a valve ball 87 is seated on the outlet 83. The number of these vertical grooves may be selected as desired. Accordingly, again in the fourth embodiment, as in the case of the second and third embodiments, when the engine is re-started from a state in which the cam nose 57 bears against the surface of contact 52, the valve ball 87 moves from the oil outlet 83 to the valve seat 81 and is seated thereon.

Therefore, the external air drawn in through the oil outlet 83 is blocked by the second valve seat 81, so that such air will not be drawn into the reservoir chamber 17 and high pressure chamber 29 of the lash adjuster 50 and thus will not impair the function of the lash adjuster 50. The second valve seat 81 in the fourth embodiment may be the same as the second valve seat 39 in the second embodiment. As in the second and third embodiments, the valve ball 87 may be biased toward the second valve seat 81 by a compression coil spring or like spring in non-vertical installations, such as in V-type or horizontally opposed engines.

Figure 3B:
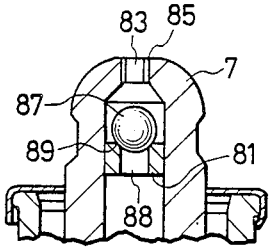
FIG. 3B is an axial fragmentary cross-sectional view of a lash adjuster according to a fourth embodiment of the present invention.

As shown in FIG. 3B, the second valve seat 81 in the fourth embodiment, may be provided with a tapered portion 89 formed by chamfering the circumferential edge of a through-hole 88 which extends axially. This is for stabilizing the seating of the valve ball 87 in the valve seat 81. The through-hole 41 of the second valve seat 39 in the second embodiment may be provided with a similar tapered portion.

In each of the above described embodiments, a ball-type check valve type device is used as the valve device, but alternatively, a one-way valve such as a poppet valve may be used as such valve device.

It has been confirmed by experiment that a lash adjuster having a separator and a valve device according to the present invention is substantially more effective than a conventional lash adjuster, particularly when the return stroke from the cam nose is great.

Since a valve device is provided in the plunger cap of the lash adjuster, even when the engine is restarted with the cam nose bearing against the surface of contact of the swing arm, the external air is not drawn into the lash adjuster (more specifically, into the high pressure chamber). Therefore, the high pressure oil in the high pressure chamber does not become spongy.

Also, since a separator is provided in the reservoir chamber in the lash adjuster, the oil in the reservoir chamber (which has little or no air mixed therewith) can be protected from the air in the lubricating oil introduced into the adjuster, whereby the oil in the reservoir chamber can be kept substantially free of air. As a result, during the operation of the lash adjuster, the oil introduced into the high pressure chamber will also be substantially free of air.

Accordingly, the invention provides a hydraulic lash adjuster which is stable in operation and which can sufficiently follow even high-speed revolution of the engine.

We claim:

1. A hydraulic lash adjuster for adjusting the valve clearance of an engine valve and for supplying oil to lubricate a surface, comprising:

a cup-shaped body having an oil introducing port and an inner chamber;

a plunger assembly axially movably fitted in said inner chamber and including a partition wall which divides said inner chamber transversely to the chamber axis into first and second compartments and which has a hole providing fluid communication between said first and second compartments, an oil outlet port at the top of said assembly, and an oil supply inlet provided in a peripheral wall of said assembly to communicate with said oil introducing port;

a high pressure chamber defined in said first compartment of said inner chamber and having first valve means for seating on said hole of said partition wall;

a reservoir chamber defined in said second compartment and being fluid communication with said high pressure chamber by way of said hole of said partition wall;

a separator provided in said plunger assembly and dividing said reservoir chamber into two spaces, an outer surface of said separator and a substantially opposed inner surface of said plunger assembly together defining a space which converges in the direction of said oil outlet port; and second valve means provided in said plunger assembly in fluid communication with said reservoir chamber and said oil outlet port for allowing oil introduced through said oil introducing port and said oil supply inlet to flow therethrough to be ejected from said oil outlet port but preventing outside air from being drawn into said reservoir chamber through said oil outlet port when the pressure of the outside air exceeds the pressure of the introduced oil.

2. A hydraulic lash adjuster according to claim 1, wherein said plunger assembly comprises a plunger axially movably fitted in said inner chamber and a plunger cap axially movably fitted in said inner chamber in contact with said plunger, and wherein said separator is fitted into said plunger cap and said oil outlet port is provided at the top of said plunger cap.

3. A hydraulic lash adjuster according to claim 2, wherein said second valve means comprises a valve ball and first and second valve seats provided in said plunger cap and holding said valve ball therebetween, said second valve seat has a hole disposed for seating of said valve ball thereon and is spaced from said first valve seat in the direction of said plunger, and an oil passage means is defined between an axially extending cutout provided on a peripheral surface of said first valve seat and an inner surface of said plunger cap for allowing said introduced oil to flow past said first valve seat when said valve ball is seated thereon.

4. A hydraulic lash adjuster according to claim 2, wherein said second valve means comprises a valve ball and first and second valve seats holding said valve ball therebetween and having respective axially extending holes disposed for seating of said valve ball thereon, and wherein said first valve seat is provided integrally at the top of said plunger cap, said second valve seat is provided in said plunger cap spaced from said first valve seat in the direction of said plunger, and an inner surface of said hole of said first valve seat has axially extending oil passage groove means for allowing said introduced oil to flow through said valve seat when said valve ball is seated on said hole of said first valve seat.

5. A hydraulic lash adjuster according to claim 4, wherein said second valve means further comprises a spring which urges said valve ball toward said second valve seat.

6. A hydraulic lash adjuster according to claim 2, wherein said second valve means comprises a valve ball and first and second valve seats holding said valve ball therebetween and having respective axially extending holes disposed for seating of said valve ball thereon, and wherein said first valve seat is provided near the top of said plunger cap, said second valve seat is provided in said plunger cap spaced from said first valve seat in the direction of said plunger, and said first valve seat has radially extending oil passage groove means provided on a surface thereof for allowing said introduced oil to flow through said valve seat when said valve ball is seated on said hole of said first valve seat.

7. A hydraulic lash adjuster according to claim 6, wherein said second valve means further comprises a spring which urges said valve ball toward said second valve seat.

8. A hydraulic lash adjuster according to claim 6, wherein said second valve seat is provided integrally with said plunger cap.

9. A hydraulic lash adjuster for adjusting the valve clearance of an engine valve and for supplying oil to lubricate a surface, comprising:

a cup-shaped body having an oil introducing port and an inner chamber;

a plunger assembly axially movably fitted in said inner chamber and including a partition wall which divides said inner chamber transversely to the chamber axis into first and second compartments and which has a hole providing fluid communication between said first and second compartments, an oil outlet port at the top of said assembly, and an oil supply inlet provided in a peripheral wall of said assembly to communicate with said oil introducing port;

a high pressure chamber defined in said first compartment of said inner chamber and having first valve means for seating on said hole of said partition wall;

a reservoir chamber defined in said second compartment and being in fluid communication with said high pressure chamber by way of said hole of said partition wall; and a separator provided in said plunger assembly and dividing said reservoir chamber into two spaces, said separator being disposed and shaped such that a space defined between an inner surface of said plunger assembly and an outer surface of said separator converges toward said oil outlet port; and wherein the diameter of said oil outlet port is defined in such a manner as to generate back pressure in said reservoir chamber.

10. A hydraulic lash adjuster according to claim 9, wherein said oil outlet port is of small diameter relative to that of an oil passage of said plunger assembly leading thereto.

11. A hydraulic lash adjuster according to claim 9, wherein said plunger assembly comprises a plunger axially movably fitted in said inner chamber and a plunger cap axially movably fitted in said inner chamber in contact with said plunger, and wherein said separator is fitted into said plunger cap and said oil outlet port is provided at the top of said plunger cap.

12. A hydraulic lash adjuster according to claim 11, wherein said separator is of substantially frusto-conical shape converging toward said oil outlet port to an end opening of said separator.

13. A hydraulic lash adjuster according to claim 9, wherein said separator is of substantially frusto-conical shape converging toward said oil outlet port to an end opening of said separator.

14. A hydraulic lash adjuster according to claim 13, wherein said inner surface of said plunger assembly converges toward said oil outlet port and is substantially opposed to the converged end portion of said separator.

15. A hydraulic lash adjuster for adjusting the valve clearance of an engine valve and for supplying oil to lubricate a surface, comprising:

a cup-shaped body having an oil introducing port and an inner chamber;

a plunger assembly axially movably fitted in said inner chamber and including a partition wall which divides said inner chamber transversely to the chamber axis into first and second compartments and which has a hole providing fluid communication between said first and second compartments, an oil outlet port at the top of said assembly, and an oil supply inlet provided in a peripheral wall of said assembly to communicate with said oil introducing port;

a high pressure chamber defined in said first compartment of said inner chamber and having first valve means for seating on said hole of said partition wall;

a reservoir chamber defined in said second compartment and being in fluid communication with said high pressure chamber by way of said hole of said partition wall; and a separator provided in said plunger assembly and dividing said reservoir chamber into two spaces, said separator being of substantially frusto-conical shape converging toward said oil outlet port to an end opening of said separator, with an inner surface of said plunger assembly and an outer surface of said separator defining a space that converges toward said oil outlet port.

16. A hydraulic lash adjuster according to claim 15, wherein said plunger assembly comprises a plunger axially movably fitted in said inner chamber and a plunger cap axially movably fitted in said inner chamber in contact with said plunger, said separator is fitted into said plunger cap, and said oil outlet port is provided at the top of said plunger cap.

17. A hydraulic lash adjuster according to claim 15, wherein said inner surface of said plunger assembly converges toward said oil outlet port and is substantially opposed to the converged end portion of said separator.

* * * * *